US005644900A

United States Patent [19]

Steele et al.

[11] Patent Number: 5,644,900

[45] Date of Patent: Jul. 8, 1997

[54] MULTIWALL BAG

[75] Inventors: Raymond George Steele, Manurewa; Stephen John Grace, Parua; John Frederick Robinson, Titirangi; Andreas Karl Haussrer, Kelston; Eric John Brown, Papakura; Michael John Kane, Point Chevalier; Allan Paul MacFarlane, Pakuranga; Ian Murray Allerby, Epsom, all of New Zealand

[73] Assignee: Stone Container Corporation, Chicago, Ill.

[21] Appl. No.: 484,643

[22] Filed: Jun. 7, 1995

Related U.S. Application Data

[62] Division of Ser. No. 192,710, Feb. 7, 1994, abandoned.

[51] Int. Cl.[6] ..... B65B 11/58

[52] U.S. Cl. ..... 53/449; 493/210; 493/933

[58] Field of Search ..... 53/449, 491, 492; 493/210, 217, 218, 219, 933; 383/91, 67, 98, 99, 111, 115, 210, 211

[56] References Cited

U.S. PATENT DOCUMENTS

| | | | |
|---|---|---|---|
| 1,833,675 | 11/1931 | Geimer . | |
| 2,161,071 | 6/1939 | McGrath et al. | 53/449 |
| 2,255,975 | 9/1941 | Hultkrans | 53/449 |
| 2,396,565 | 12/1946 | Gardner | 229/58 |
| 2,582,286 | 1/1952 | Schenck | 229/62 |
| 2,833,094 | 5/1958 | Moore | 53/449 |
| 2,948,457 | 8/1960 | Thiele | 229/62 |
| 3,306,522 | 2/1967 | Konsel | 383/115 |
| 3,485,438 | 12/1969 | McCall et al. | 383/115 |
| 3,599,539 | 8/1971 | Coverstone | 443/933 |
| 3,807,626 | 4/1974 | Goodrich | 229/55 |
| 3,929,275 | 12/1975 | Bolling et al. | 229/55 |
| 3,958,749 | 5/1976 | Goodrich | 229/55 |
| 4,260,061 | 4/1981 | Jacobs | 206/626 |

FOREIGN PATENT DOCUMENTS

| | | | |
|---|---|---|---|
| 126602 | 12/1944 | Australia . | |
| 51656 | 9/1969 | Australia . | |
| 0172179 | 9/1988 | European Pat. Off. | B65D 33/18 |
| 0023252 | 1/1931 | Netherlands | 53/449 |

OTHER PUBLICATIONS

International Organization for Standardization, ISO 6590/1; "Packaging–Sacks–Vocabulary and types —Part 1: Paper sacks" (1983); pp. 6,8.

"Bag Making Adhesives", National Starch and Chemical Corporation, 1971.

Wiley Encyclopedia of Packaging Technology, 1986, pp. 14–16.

"AMV 2170" Brochure —before Feb. 1994.

"Paper Sacks–A User's Guide", Finch Partnership Limited, Liverpool, England 1973.

"The Combined Paper–Plastic Sack", Converter, Nov. 1973, pp. 14–16.

*Primary Examiner*—James F. Coan
*Assistant Examiner*—Gene L. Kim
*Attorney, Agent, or Firm*—Dick and Harris

[57] ABSTRACT

A container apparatus and method of manufacture for same, in which the container includes an inner tube formed of plastics material, and an outer tube of one or more plies of material. The container is generally configured to lie flat, when in its unfilled condition. The container has a flat first end formed from flap members configured from one or more plies of the outer tube. The container is advantageously configured to enable opening of the first end of the outer tube to provide access to the inner tube.

6 Claims, 7 Drawing Sheets

MULTIWALL BAG

This is a division of application Ser. No. 08/192,710, filed Feb. 7, 1994 now abandoned.

BACKGROUND OF THE INVENTION

The present invention relates to improvements in and or relating to bags of multiple plies, apparatus for manufacturing same, methods of manufacturing same, uses thereof and related means and methods.

Many forms of bag containers formed of multiple plies are known. Many of these are in the form of a multiwall bag sometimes with a plastics material inner liner. The present invention is directed to improvements in such a container and is adapted to provide at least some customer choice in relation to containers of that type.

A prior art form of construction is that as hereinafter described and the present invention is preferably directed to a form of such container where no base patch is required that is separate from the plies of the outer tube of such a container and/or which, upon opening, will minimize loose pieces of material.

It is, therefore, an object of the present invention to go at least some way to meet the above-mentioned objects or at least provide the public with a useful choice.

SUMMARY OF THE INVENTION

In a first aspect the invention consists in a lie flat container (e.g. a bag) having a tube (extruded or fabricated) of a sealable plastics material (hereafter "the inner tube") disposed within an exterior tube (hereafter "the outer tube"), each tube having been formed of at least one web of a planar material (preferably paper or multiple plies of paper), the same end (hereafter the "first" or "factory" end) of each of the inner tube and outer tube being separately closed while the other end of each of the inner tube and outer tube is open (hereafter the "second" or "customer" end) to allow the filling of the inner tube prior to the sealing thereof, and wherein, in its lie flat, unfilled condition, each tube simply lies as a simple fold connected front and back panel except at the factory end where the outer tube at least has been conformed from factory end regions of the front and back panels of the outer tube to a substantially planar base region disposed in a lie flat condition over one or other of the front or back panels of the outer tube, said outer tube at said factory end being held closed at least primarily by overlying flaps from the factory end extremity of each of the front and back panels, the flaps while adhered one to the other being capable of being peel separated so that, in use, if desired, the filled and sealed inner tube, if not permanently attached to the outer tube at the customer end, can be removed from the factory end after the peel separation of the flaps to allow opening of the outer tube at the factory end.

In a preferred embodiment of the invention, the container is in the form of a bag, with the exterior tube being formed from paper, preferably from multiple plies of paper. Preferably, the inner tube at the customer end is adhered at least in a tack manner to the outer tube at the customer end to facilitate filling of the inner tube.

Preferably one or both of the flaps is of a multiple ply construction.

Preferably the overlying flap of the base at the factory end is of a multiple ply and part of one ply of the overlying flap is adhered to the factory end of the inner tube while the factory end of the inner tube is adhesively associated with at least one ply of the underlying flap.

Preferably the container operates such that, when lying substantially horizontally, the overlying flap of the base can be lifted by a person using one or two hands, the container then being movable to a condition where the base is directed downwardly and the weight of the contents in the inner tube will allow the dropping free thereof from the outer tube or the lifting free of the outer tube from the inner tube or a combination of both by breaking associations and/or adhesive associations without releasing any substantial loose pieces of material from the outer tube and/or inner tube.

The container is preferably substantially rectangular in form.

Preferably the outer tube is substantially as hereinafter described with reference to any one or more of the accompanying drawings.

In another aspect the invention is a container substantially as hereinafter described with reference to any one or more of the accompanying drawings other than FIGS. 3A, 3B and 3C.

In still a further aspect the invention consists in a method of forming a lie flat container having a tube of a sealable plastics material (hereafter "the inner tube") disposed within an exterior tube (hereafter "the outer tube"), each tube having been formed of at least one web of a planar material, the same end (hereafter "the factory end") of each of the inner tube and outer tube being separately closed while the other end of each of the inner tube and outer tube is open (hereafter "the customer end") to allow the filling of the inner tube prior to the sealing thereof, and wherein, in its lie flat, unfilled condition, each tube simply lies as a simple fold connected front and back panel except at the factory end where the outer tube at least has been conformed from factory end regions of the front and back panels of the outer tube to a substantially planar base region disposed in a lie flat condition over one or other of the front or back panels of the outer tube, said outer tube at said factory end being held closed at least primarily by overlying flaps from the factory end extremity of each of the front and back panels, the flaps while adhered one to the other being capable of being peel separated so that, in use, if desired, the filled and sealed inner tube, if not permanently attached to the outer tube at the customer end, can be removed from the factory end after the peel separation of the flaps to allow opening of the outer tube at the factory end, which method comprises the steps of:

advancing a feed of a inner tube and a outer tube, the inner tube being within the outer tube, heat sealing the factory end of the advanced inner tube, spreading the factory end of the advanced outer tube out together with part of the sealed factory end of the inner tube to define a lie flat base but from which extends in opposite directions (parallel to the locus of advancement) said flaps of the base and thereafter adhesively inter-engaging said flaps, the completed lie flat container structure being a discrete item after, if necessary, a cutting of the feeds of material at the customer end.

Preferably said method involves the.. use of one or several plies of a paper from which the outer tube is to be formed, a tubular plastics material from which the inner tube is formed, forming the outer tube about the inner tubular material, making appropriate perforations and/or cuts as well as a heat seal to close the inner tube of the plastics material and sequentially adhesive closing the factory end of the outer tube in the manner determinable by reference to any of the accompanying drawings other than FIGS. 3A, 3B and 3C.

In still a further aspect the invention consists in a method of forming a container substantially as hereinafter described when performed substantially as hereinbefore described with reference to any one or more of the accompanying drawings.

In a further aspect the invention is any container of the present invention when the inner tube has been filled with a material and the inner tube is sealed at the customer end and the outer tube is also sealed at the customer end.

The material with which the inner tube is filled is preferably a powder or liquid.

In a further aspect the invention consists in a method of handling a material capable of being poured selected from a powder, liquid or discrete items, such as granules, which involves the operative use of a lie flat container of the present invention and/or one produced by a method of the present invention and/or the opening and removal of a filled inner tube from the outer tube thereof that has been sealed at the customer end.

In a further aspect the invention is a method of handling a material when performed substantially as hereinafter described with reference to the accompanying drawings.

The invention consists in the foregoing and also envisages constructions of which the following gives examples.

BRIEF DESCRIPTION OF THE DRAWINGS

FIG. 1A shows a bag, according to the present invention, substantially lying flat presenting the base region for opening;

FIG. 1B shows the bag according to FIG. 1A, in which the outer flap of the base region is being pulled so as to separate the adhesively fixed overflap from the other flap;

FIG. 1C shows the full opening of the outer flap;

FIG. 1D goes the next stage where the bag is about to be lifted upright;

FIG. 1E shows the bag when lifted upright with the inner tube full of a powder or liquid material fall free of the outer tube notwithstanding any slight adhesive or other tacking of the inner tube to the factory end of the outer tube;

FIGS. 2AA to 2CC show a slightly different embodiment to the form as shown in FIGS. 2A to 2C, this different embodiment providing for a greater glued flap overlap.

DETAILED DESCRIPTION OF THE DRAWINGS

Figure 1A:
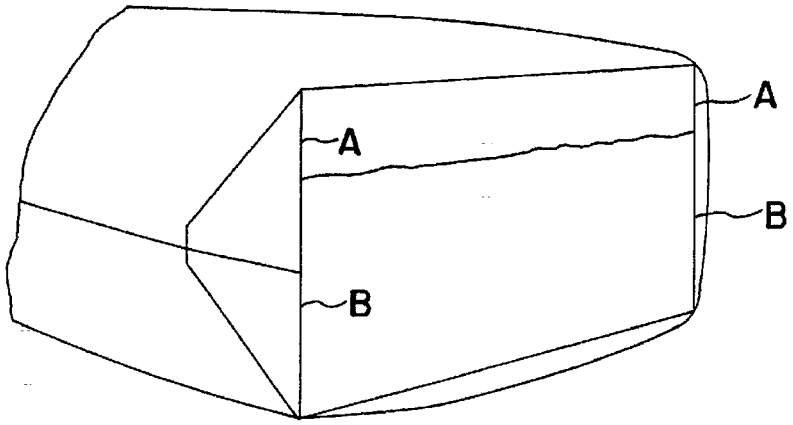
FIGS. 1A through 1E show the factory end of a preferred bag like container in accordance with the present invention.
Figure 1B:
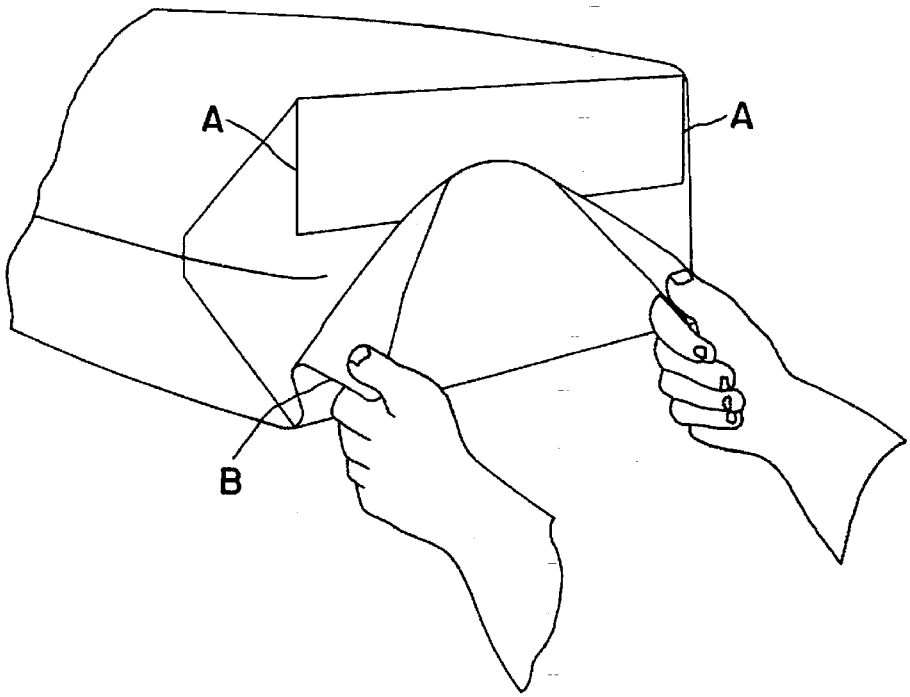
Figure 1C:
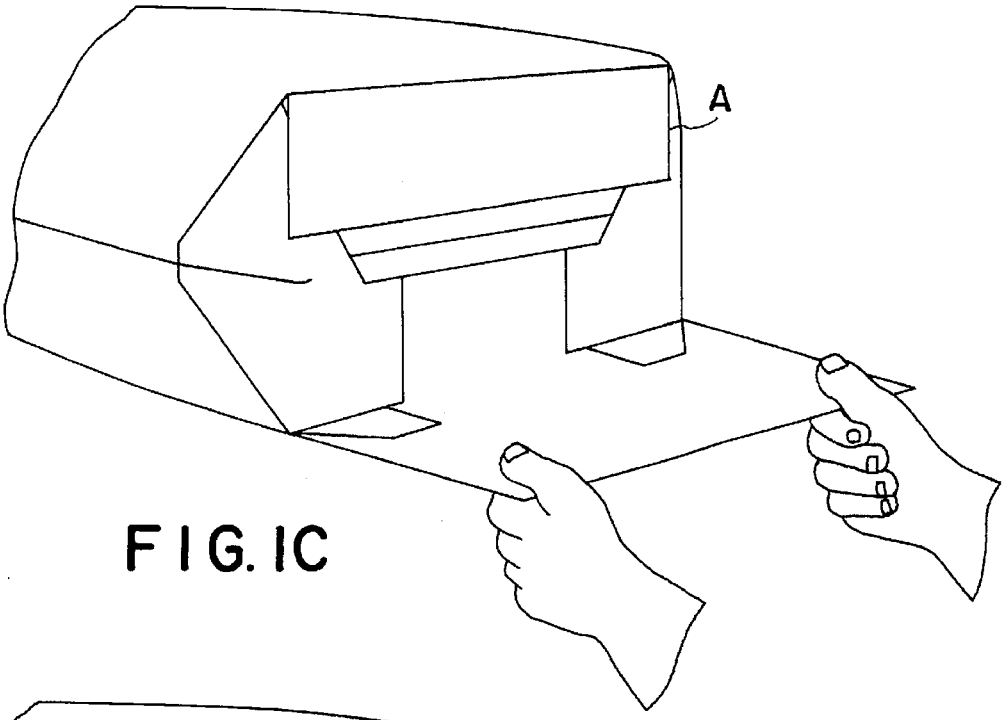
Figure 1D:
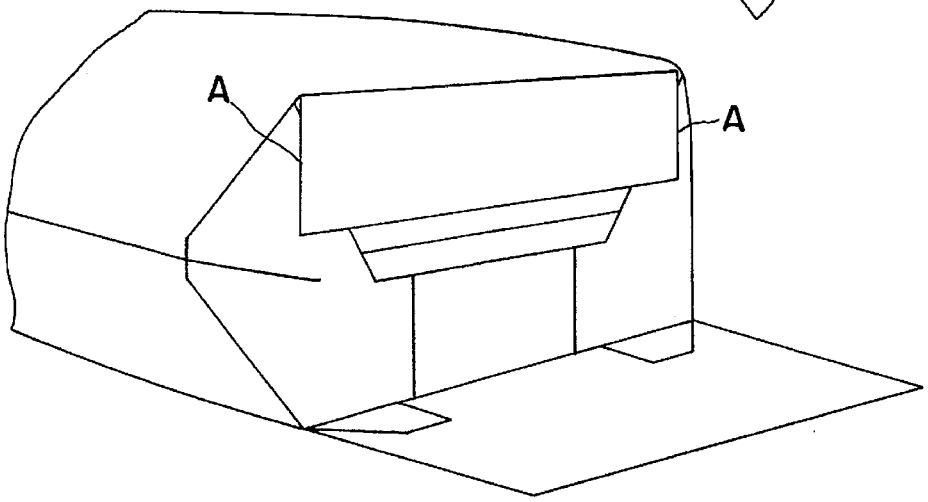
Figure 1E:
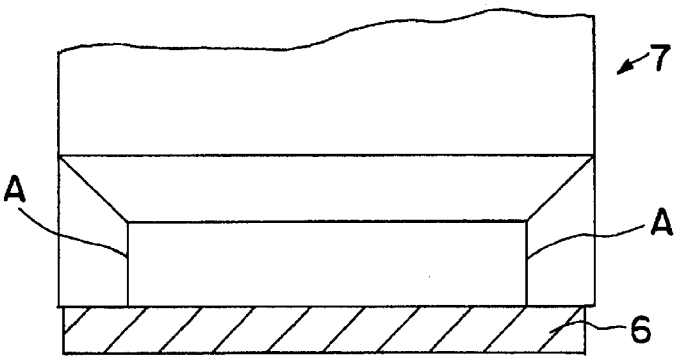

While this invention is susceptible of embodiment in many different forms, there is shown in the drawings and will be described herein in detail, several embodiments, with the understanding that the present disclosure is to be considered as an exemplification of the principles of the invention and is not intended to limit the invention to the embodiments illustrated.

The preferred container as depicted in the enclosed drawings is preferably formed using an adaption of existing continuous multiple ply walled manufacturing apparatus. Preferably the outer tube is formed from multiple plies of paper preferably with staggered ends developed by appropriate cutting and/or perforation and any necessary separation procedures all of which are known in the art.

Figure 3A:
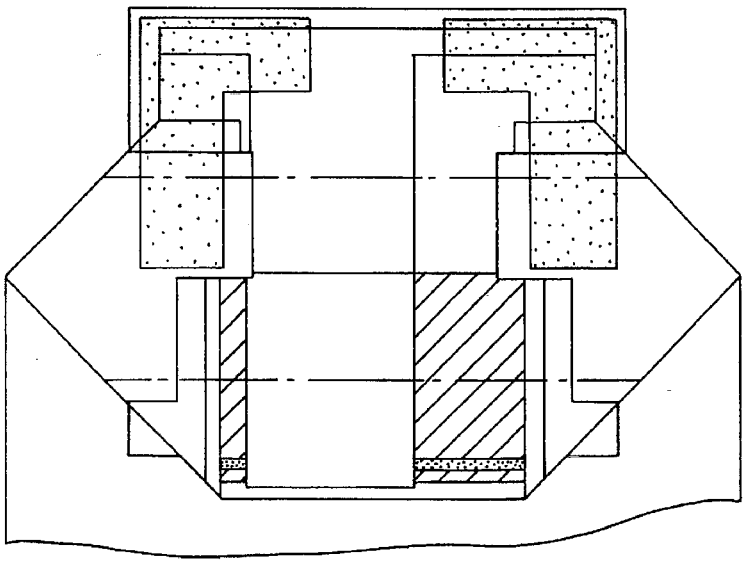
FIG. 3A PRIOR ART
FIGS. 3A to 3C are similar to those of FIGS. 2A to 2C but are in relation to a prior art arrangement whereby there is a separate flap adhesively secured to the plies of material from which the outer tube has been made.
Figure 3B:
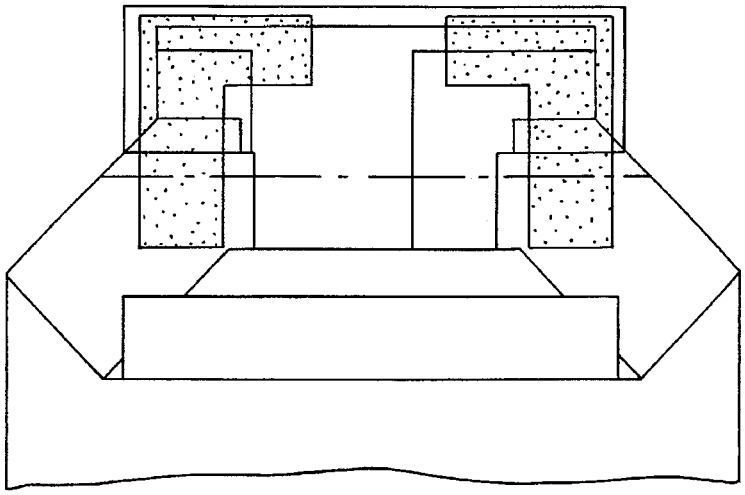
FIG. 3B PRIOR ART
Figure 3C:
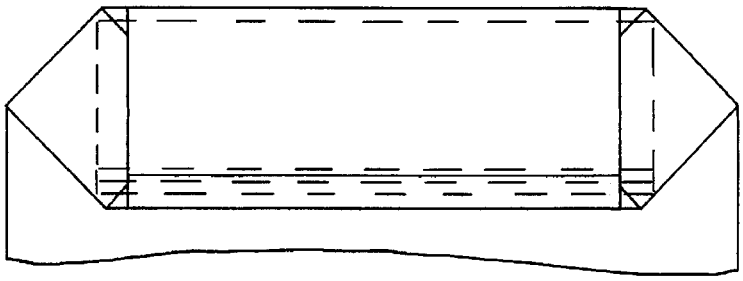
FIG. 3C PRIOR ART

The present invention differs significantly from the prior art form of multiple ply bags with a plastic liner bag which had a separate base patch provided on the outer tube as depicted in FIGS. 3A to 3C as previously supplied to the New Zealand Dairy Board, which adds complexity to manufacture and/or at least cost thereto and/or minimizes the re-use that customers of the end product may make of the resulting bag. In this respect it should be realized that in some third world countries the outer tube, once emptied, forms a valuable resource and, therefore, minimization of destruction upon opening is desirable. Moreover a reduction of pieces that become severed from the outer tube during opening desirably should also be minimized.

Preferably the opening of the outer tube and the unloading of the still sealed inner tube is by the sequence of steps as shown in FIGS. 1A through 1E, all of which are self-explanatory.

Figure 4:
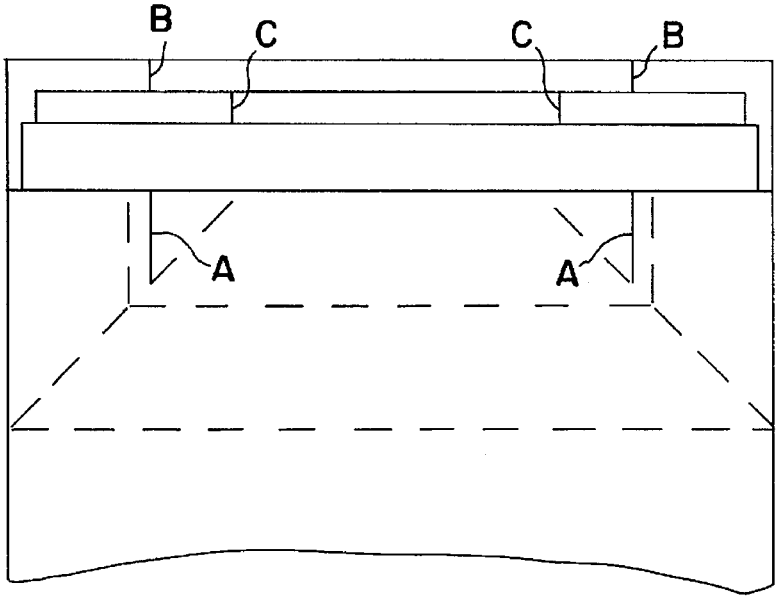
FIG. 4 is a view of the factory end of the outer tube prior to its condition as in FIG. 2A but from the side as depicted in FIG. 2A.
Figure 5:
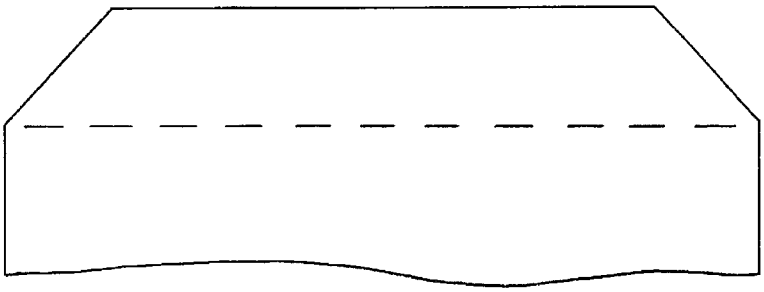
FIG. 5 is a view of the factory end as shown in FIG. 2C but from the other side.
Figure 6:
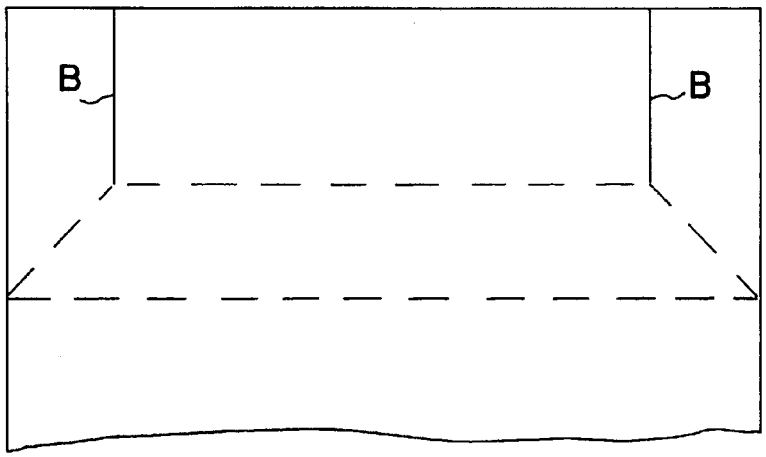
FIG. 6 is similar to FIG. 4 but showing the factory end from the other side.

The first or factory end of the outer tube is shown in the drawings with the lines A shown for clarity of the drawings being those cuts A also seen in FIG. 4. Likewise lines B are cuts B of FIGS. 4 and 6.

Figure 2A:
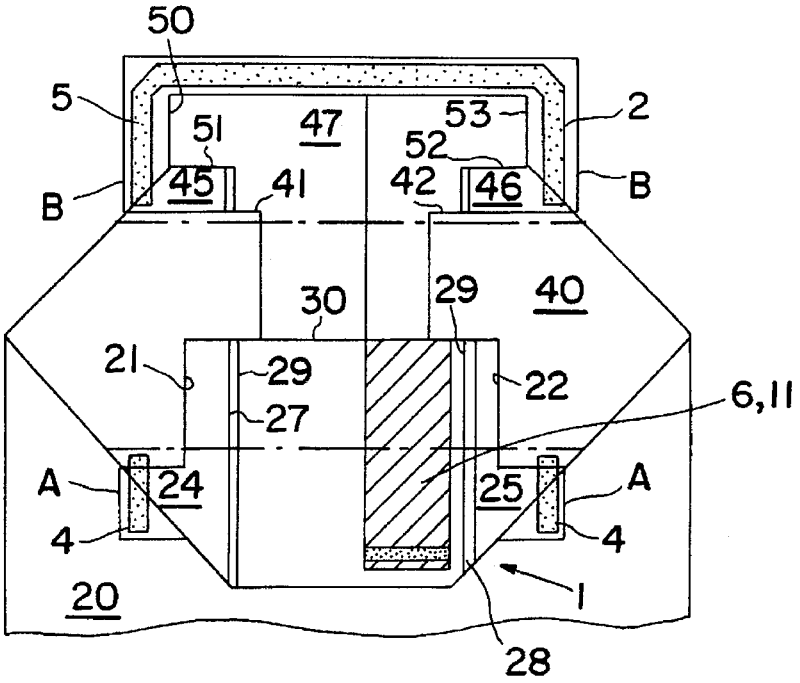
FIGS. 2A to 2C show the final folds together with adhesive regions giving rise to the base region connected by gussets to the front and rear panels of the outer tube as shown in FIG. 2C, it not mattering whether or not the base regions lies flat over what might be considered a front or back panel.
Figure 2B:
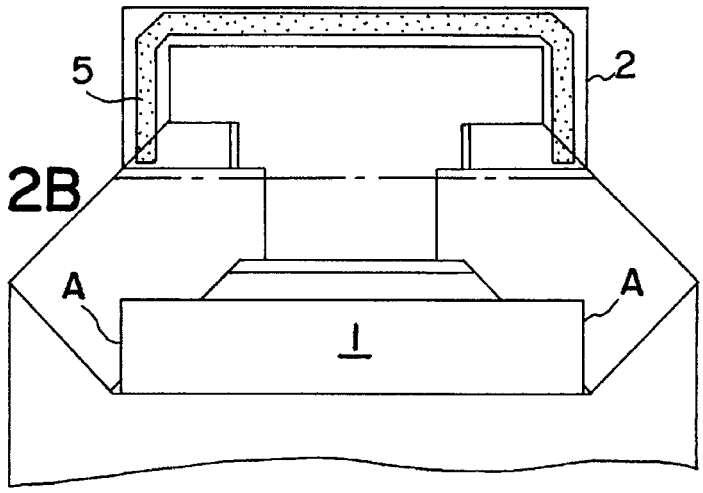
Figure 2C:
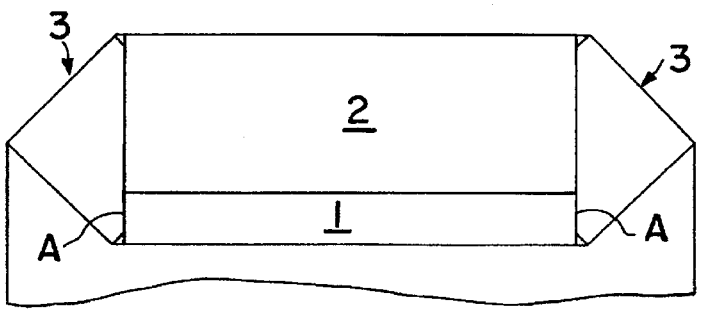

In the preferred form of the present invention, the outer tube has the gusset connection base region thereof formed from flaps 1 and 2 with flap 2 overlying flap 1 (as can best be seen in FIGS. 2A through 2C) with the gusseted regions 3 of the lie flat base region over the front or back panel (as the case may be) as in FIG. 2C.

Figure 7:
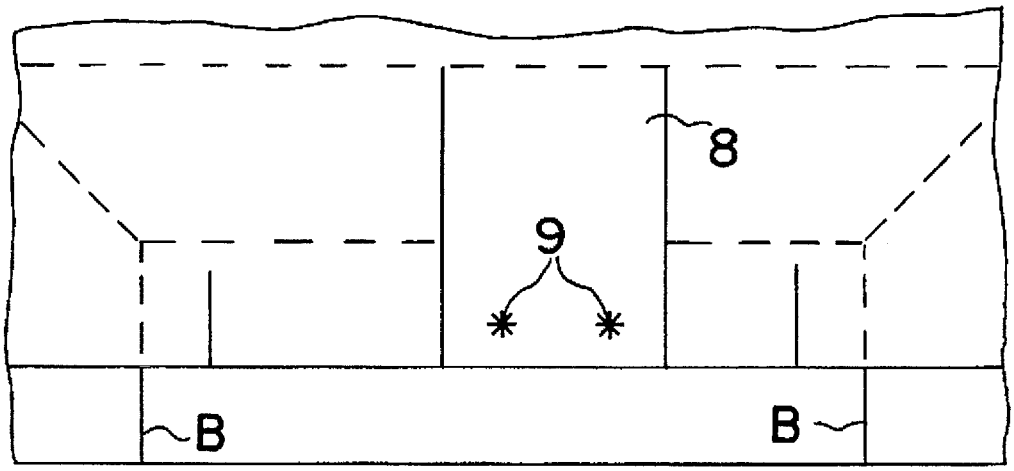
FIG. 7 is a tipped over, inside view of the factory end side shown in FIG. 6.
Figure 8:
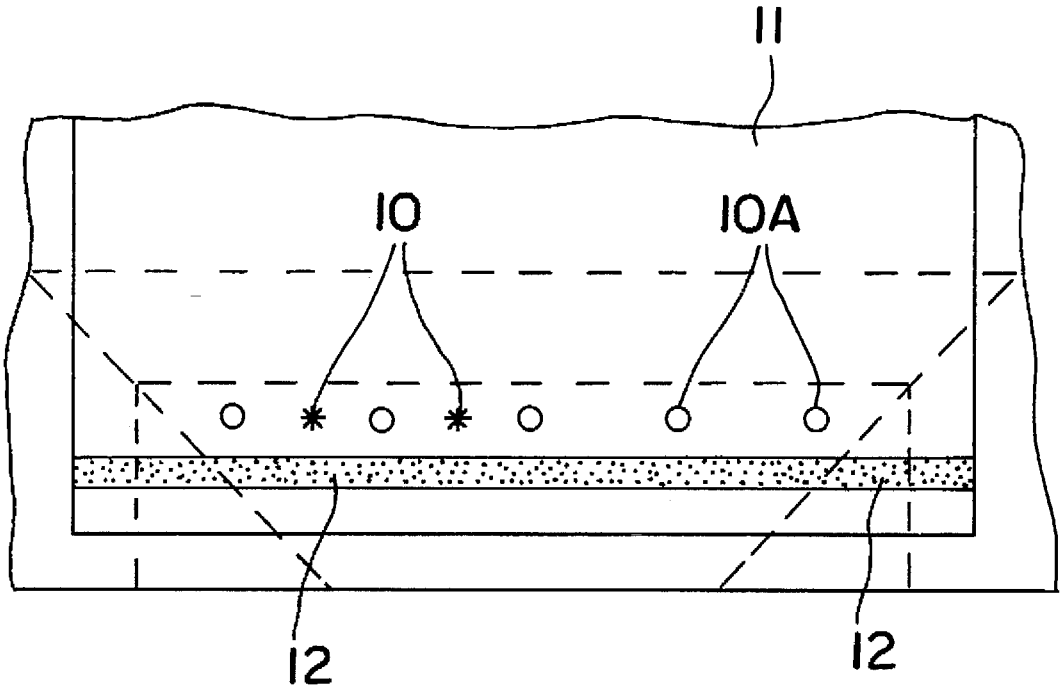
FIG. 8 is the tipped over, inside view of the factory end side shown in FIG. 4.

FIG. 2A shows how the flap 1 has its perimeter regions bounded by the cuts A shown in FIG. 4 provided with glue lines 4 while flap 2 includes a glue line 5. The glue lines 4 are not normally broken as can be seen in FIGS. 1B through 1E prior to the use of gravity to assist in the removal of an inner tube 6 from within the outer tube 6, i.e., the tearing apart as in FIGS. 1B and 1C leaves the base region in the manner substantially as it was prior to the move during forming from FIG. 2B and 2C. There is, however, the difference in that the region 8 shown in FIG. 7 has adhesive applied at positions 9 and that flap from one of the inner webs of one panel of the outer tube is adapted to be adhered a points 10 on the sealed inner tube 11 (see FIG. 8), the first or factory end of the inner tube being heat sealed along the heat seal line 12. Preferably, there is an adhesive fixing of the inner tube 11 to the other ply also but in an easily releasable manner. This adhesion is denoted by circles 10A and is under the inner tube 11 in FIG. 8.

The bag of FIGS. 1A–2C can readily be seen to have three layers to its outer portion 6. The side of the bag which corresponds to flap 1 may be considered the front, while the side of the bag which corresponds to flap 2 may be considered the back.

In the embodiment illustrated, the middle and inner layers have edges which are, in places coterminous, and only a single line representing such coterminous edges, is illustrated.

The outermost layer, on the front, is the layer corresponding to cuts A, and includes surface 20 and edges 21,22. The middle layer, is the layer corresponding to visible surfaces 24, 25. The innermost layer is the layer corresponding to visible surface 28. Edges 29 of the innermost layer indicate where upon folding, edges 29 would cease to be coterminous with edges 27 of the middle layer, and would extend slightly inwardly, relative to edges 29. Line 30 shows the crease in the front side representing the fold created when the bottom of the bag is caused to lie flat and generally parallel to the main tubular portion of the bag.

The outermost layer on the back side, is the layer corresponding to cuts B, and includes surface 40, and edges 41, 42. The middle layer on the back is the layer corresponding to visible surfaces 45 and 46, and edges 50–53. The innermost layer on the back side corresponds to surface 47.

The particular staggering and contours of the plies of the outer portion 6 are shown only by way of example, and may be varied without departing from the scope of the invention, so long as two inner flaps, such as flaps 60, 61 (FIG. 2B) are provided, and two outer flaps 1 and 2 are provided, since the adhesive which is provided to create the peel openable bottom is applied over the surfaces as a whole, independently of the staggering and overlapping of the individual plies.

Persons skilled in the art, from the drawings, will appreciate the sequential manner in which the multiply outer tube and the inner tube (11, 6) is formed at its first or factory end. The manner in which first the inner tube and then the outer tube or simultaneously the inner tube and outer tube are sealed, preferably the inner tube with heat sealing, at the customer end is not relevant to an understanding of the invention but any conventional means might be used. The choice of an envelope grade adhesive capable of being opened as in FIGS. 1A to 1E is preferred as an appropriate adhesive can ensure total success.

FIGS. 2AA through 2CC are very similar drawings to FIGS. 2A through 2C but showing how, with the slightly different arrangement of the staggering of the plies, a greater glued flap area can be provided to provide a stronger adhesive overlap but still be within the scope of the present invention.

The adhesives capable of being utilized in the forming of a bag in accordance with the present invention include the following:

Liquid Adhesives Including: Starches, Dextrines, Polyvinyl Alcohol, Animal, Casein;.

Latex Adhesive Including: Natural, Synthetic;

Emulsion Polymers Including: Polyvinyl Acetate Homopolymers, Ethylene/Vinyl Acetate Copolymers, Acrylate/Vinyl Acetate Copolymers, Polyethylene, Amorphous Polypropylene, Polyamide; and Solvent Based: Polyurethanes, Natural Polymer, Synthetic Polymers, Two Pot Systems.

The use of a container of the present invention provides some, if not all, of the advantages previously referred to.

The construction of the container of the present invention is such that when a filled container is lying substantially horizontally, the overlying flap of the base can be lifted by a person using one or two hands, the container then being movable to a condition where the base is directed downwardly and the weight of the contents in the inner tube will allow the dropping free thereof from the outer tube or the lifting free of the outer tube from the inner tube or combination of both by breaking associations and/or adhesive associations without releasing any substantial loose pieces of material from the outer tube and/or inner tube. This presumes that the second or customer ends of the inner and outer tubes have not been unreleaseably affixed to one another after filling, by the customer. Ideally, separate sealing of the inner tube at the second end, such as by heat sealing, followed by separate sealing of the outer tube at the second end, would facilitate removal of the filled inner tube in the manner described hereinabove.

The present invention also comprises a method of handling a liquid or granular material, or discrete items, using a container such as described.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A method of forming a container comprising the steps of:

advancing a feed of a substantially flexible inner tube and a substantially flexible outer tube, the inner tube being disposed within the outer tube, heat sealing a first end of the advanced inner tube, spreading the first end of the advanced outer tube out together with part of the sealed first end of the inner tube to define a lie flat base;

forming flap members in said first end of said outer tube, said flap members extending in opposite directions from said base, and parallel to the direction of advancement of said inner and outer tubes; and thereafter adhesively inter-engaging said flap members, beyond the sealed end of the inner tube, in such a manner that the flap members may thereafter be peel-opened so as to permit access to the inner tube without substantially damaging the outer tube, said inter-engaging of said flap members of said outer tube occurring without interlocking affixation of the first end of said inner tube to the first end of said outer tube.

2. The method according to claim 1, further comprising the step of:

cutting the feeds of material at respective second ends of said inner and outer tubes, to form a discrete flat container structure.

3. The method according to claim 1, further comprising the step of:

forming the inner tube from a plastics material.

4. The method according to claim 1, further comprising the step of:

forming the outer tube from one or more plies of paper material.

5. The method according to claim 1, further comprising the steps of:

filling said inner tube;

sealing said second end of said inner tube;

sealing said second end of said outer tube.

6. The method according to claim 5, wherein said step of filling said inner tube further comprises filling said inner tube with one of the following materials: a powder, a liquid.

* * * * *

UNITED STATES PATENT AND TRADEMARK OFFICE

CERTIFICATE OF CORRECTION

PATENT NO. : 5,644,900
DATED : July 8, 1997
INVENTOR(S) : Raymond George Steele et al.

Figures 1, 2A:
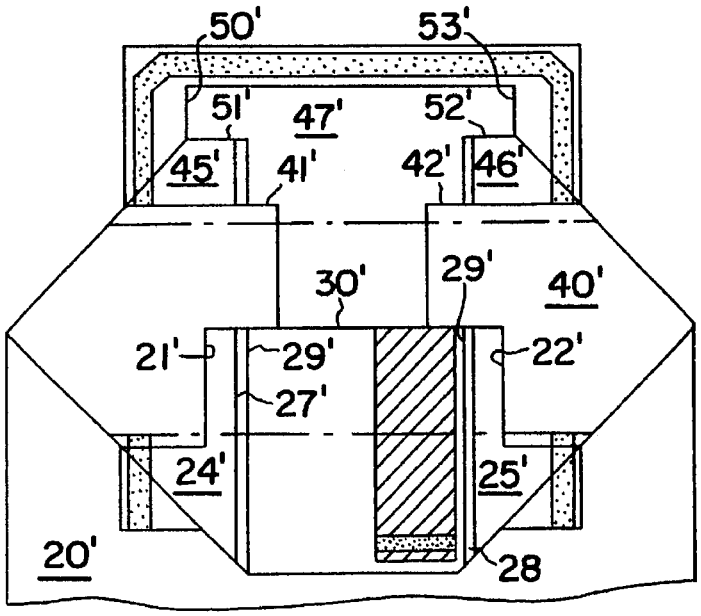
Figures 1, 2B:
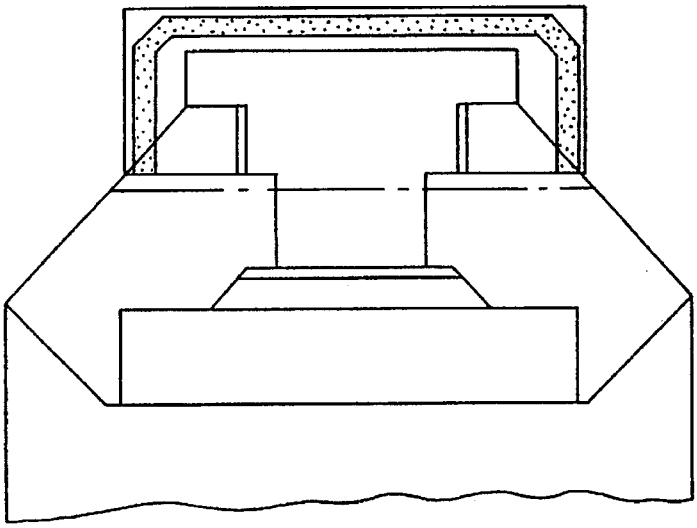
Figures 1, 2C:
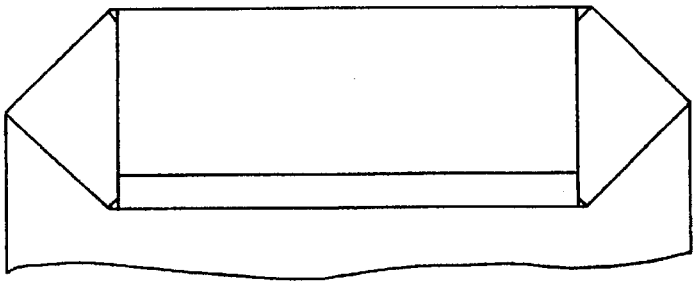

It is certified that error appears in the above-indentified patent and that said Letters Patent is hereby corrected as shown below:

| | |
|---|---|
| Col. 2, Line 58 | After "the" delete ".." |
| Col. 3, Line 65 | Delete "2AA to 2CC" and insert instead "2A-1 to 2C-1" |
| Col. 5, Line 40 | Delete "2AA through 2CC" and insert instead "2A-1 through 2C-1" |
| Col. 5, Line 45 | After "invention." insert --The embodiment of Figs. 2A-1 - 2C-1, being substantially similar to that of Figs. 1A - 2C, elements having similar structures and functions have been provided with similar reference numerals, augmented by a prime (').-- |

Signed and Sealed this

Tenth Day of February, 1998

Bruce Lehman

*Attest:*

BRUCE LEHMAN

*Attesting Officer*

*Commissioner of Patents and Trademarks*